US005647393A

United States Patent [19]

Egli

[11] Patent Number: 5,647,393

[45] Date of Patent: Jul. 15, 1997

[54] SINGLE-POINT ARMATURE

[75] Inventor: Werner Egli, Huntwangen, Switzerland

[73] Assignee: Armaturenfabrik Wallisellen AG, Wallisellen, Switzerland

[21] Appl. No.: 699,197

[22] Filed: Aug. 19, 1996

Related U.S. Application Data

[63] Continuation of Ser. No. 420,764, Apr. 12, 1995, abandoned.

[30] Foreign Application Priority Data

Apr. 18, 1994 [CH] Switzerland ..... 01158/94

[51] Int. Cl.[6] ..... F16K 21/00

[52] U.S. Cl. ..... 137/360; 137/580; 137/801; 137/878

[58] Field of Search ..... 137/359, 360, 137/801, 580

[56] References Cited

U.S. PATENT DOCUMENTS

| | | | |
|---|---|---|---|
| 4,026,328 | 5/1977 | Nelson | 137/801 |
| 4,037,624 | 7/1977 | Turner et al. | 137/801 |
| 4,778,108 | 10/1988 | Richards | 137/801 |
| 5,046,521 | 9/1991 | Jensen | 137/359 |

FOREIGN PATENT DOCUMENTS

| | | | |
|---|---|---|---|
| 293655 | 12/1988 | European Pat. Off. . | |
| 300360 | 1/1989 | European Pat. Off. . | |
| 0392176 | 2/1990 | European Pat. Off. . | |
| 2015681 | 4/1970 | France . | |
| 1909444 | 9/1969 | Germany | 137/801 |
| 2412679 | 10/1974 | Germany | 137/359 |
| 4113879 | 11/1991 | Germany . | |
| 4138938 | 6/1993 | Germany . | |
| 673689 | 3/1990 | Switzerland . | |
| 931705 | 7/1963 | United Kingdom | 137/801 |

*Primary Examiner*—A. Michael Chambers
*Attorney, Agent, or Firm*—Sughrue, Mion, Zinn, Macpeak & Seas

[57] ABSTRACT

An inner body 3 of a single lever faucet contains channels 29 for cold and hot water, and carries a mixing valve 11 with an operating lever 1. The inner body fits within a casing 2, and is equipped with a quick coupling 16 on the discharge nozzle side. Attachment members 4, 5, 6 for mounting the inner body of an armature connection unit 7 in a building wall 23 are designed for flexible connection in a rotational direction, and are removable in an axial direction. The resulting single-point armature can be economically manufactured and mounted quickly without problems in the construction trade.

15 Claims, 2 Drawing Sheets

SINGLE-POINT ARMATURE

This is a Continuation of application Ser. No. 08/420,764 filed Apr. 12, 1995 now abandoned.

BACKGROUND OF THE INVENTION

This invention relates to a single-point armature assembly which is economical to produce, and which can be mounted and assembled quickly and easily in the building construction trade. In addition, the visible parts of the armature can be quickly and economically changed in the case of maintenance.

Connection devices and single-point armatures with outflow nozzles are known. EP 0 392 176, for example, shows an arrangement of this sort, in which the body of the armature carries a mixing device, with which the run-off spout or nozzle designed as one piece and is equipped with a multi-part round anchor plate. The body of the armature has a flange with multiple bore holes through which it is form-fitted and screwed onto a connection element in a rotational direction. It is also known to design discharge armatures as a modular system, preferably by combining a base body with several discharge pieces of different lengths. It is also known that these discharge pieces are positioned rotatably at their connection point with the body of the armature and that these pivot bearings have limitations on their pivoting angle. It is further known for sanitary appliance armatures to provide inner bodies with outer sheaths as refined covers. CH 673 689 shows, for example, an armature which has such rotatably positioned covers and which can serve as a rotatable holder for a flexible discharge nozzle at the same time.

BRIEF DESCRIPTION OF THE DRAWINGS

FIG. 2 shows a coupling member of the pivoting discharge nozzle, wherein

DETAILED DESCRIPTION OF THE PREFERRED EMBODIMENT

Figure 1:
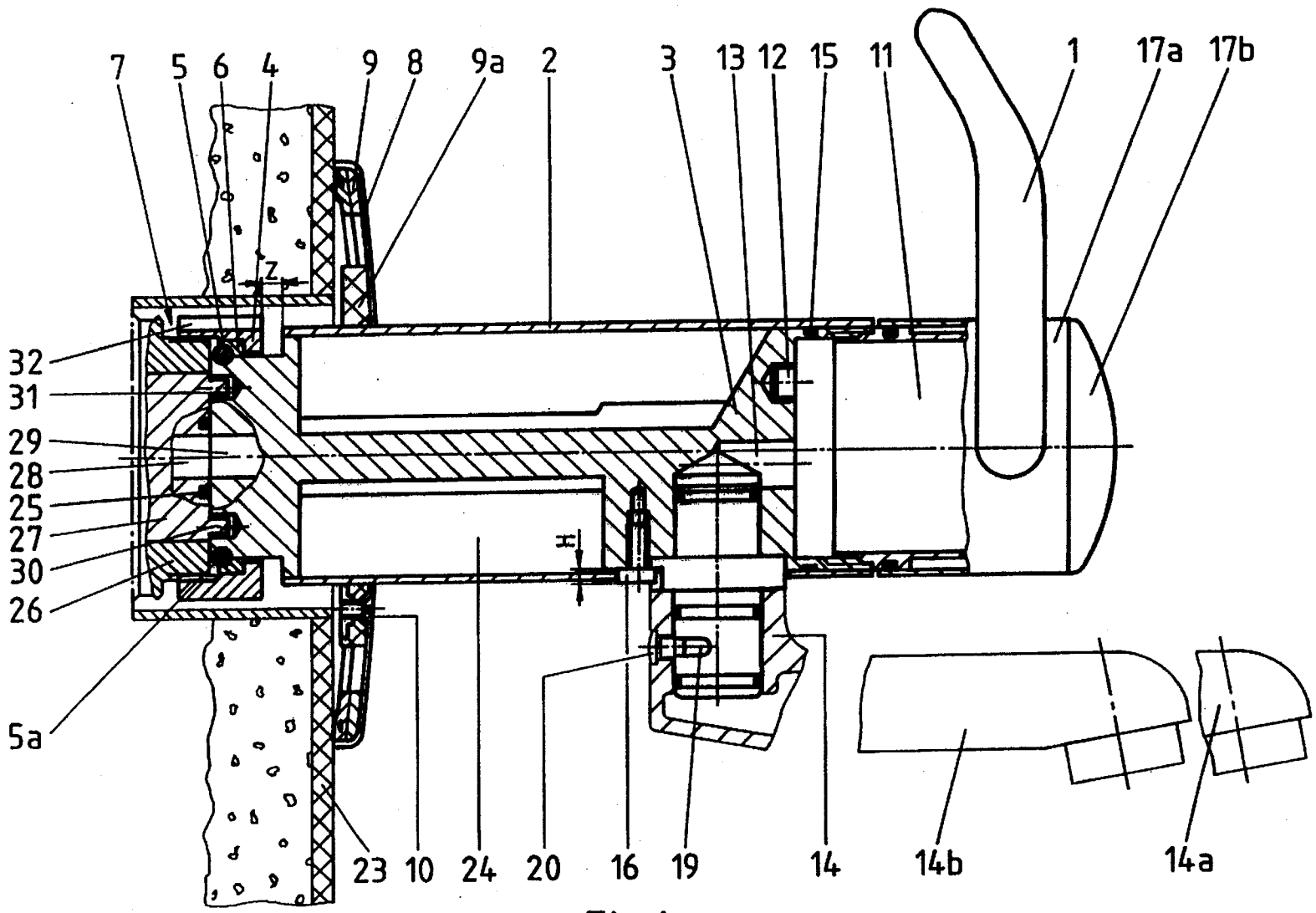
FIG. 1 is a partial cross-sectional view of a single-point armature in accordance with the invention, showing the coupling parts for the pivoting discharge nozzle and for the connection of the armature.

In FIG. 1 the single-point armature assembly contains, among other things, an operating lever 1, a casing 2, an inner body 3 which is preferably designed as a single piece, a pivot or swivel nut 4, and a retainer ring 5 seated in a ring-shaped groove 5*a* of the inner body 3, and secured by a securing ring 6. The swivel nut faces a shoulder of the inner body 3 with an axial play z corresponding approximately to its length, and connect the single-point armature with an armature connection unit 7 tightly as well as flexibly over the retainer ring 5 and the securing ring 6, and over end face seals 25. With this arrangement the fastening means (4, 5, 6) can be removed quickly and easily in the assembly direction of the armature toward the armature connection unit 7.

The armature connection unit 7 consists of a housing 26 and an insert 27 rotatable in the housing, with two offset channels 28 (only one shown) for cold and hot water, which align with corresponding channels 29 in the inner body 3. To secure the assembly against rotation, two pegs 30 formed on the insert 27 engage in corresponding bore holes 31 of the inner body 3. In this way the housing 26 can be mounted in the wall in a desired rotational position. In addition, the cold and hot water connections can be exchanged by turning the insert 27 through 180°. The flexible connection of the inner body 3 and the connection unit 7 thus makes the installation of the supply pipes easier.

A round anchor plate 8 carries a waterproof seal 9, 9*a* inside to seal against splashing on the wall 23 on one hand and on the other hand against the casing 2 of the single-point armature. A screw 10 spreads the seal 9*a* frictionally against the casing 2 when screwed in, and thus serves as a fixing element in order to maintain the pressure of the sealing means under the round anchor plate for years.

The type of fastening of the swivel nut 4 by means of the retainer ring 5 and securing ring 6 allows, on one hand, a construction of the armature casing and body 2, 3 which is smaller in diameter than the nut and, on the other hand, the quick and easy mounting of the nut 4, after which the anchor plate formed as a one-piece subassembly is pushed on the casing 2 with a loose screw 10. To ensure a simple assembly of the nut 4 with the armature connection unit 7 attached in or on the wall, it is preferable to push the anchor plate onto the casing 2 as far as possible in the direction of the operating lever 1. This provides the necessary room for the mounting keys which fit for this purpose as tool grips in longitudinal grooves 32 of the swivel nut 4 in the inside of the wall. If the mounting process is accomplished before the mounting of the coupling part for the discharge nozzle 14, then the anchor plate 8 can be pushed away from the armature connection unit 7 in the connection process with a suitably constructed geometry of the single-point armature approximately to the operating lever 1 on the armature head, which is particularly advantageous.

The inner body 3 contains the supply pipes 29 for hot and cold water from the armature connection unit 7 to a mixing element 11 containing the shut off and mixing devices or valves, which is connected with the inner body 3 by means of a cam 12 such that its inner or fixed end cannot turn, as well as with the mixed water outlet or discharge 13, which leads to the coupling part of FIG. 2 and then to the discharge nozzle 14. It also carries the casing 2, which can be pushed on over an O-ring 15 from both sides onto the inner body 3. The ability of the casing to be pushed on from both sides has the advantage that the inner body can be tested for functionality and seal tightness with the pre-assembled armature head (operating lever 1 and mixing element 11) and with the head casings 17*a* and 17*b*, but without the connection parts (nut 4, retaining ring 5 and securing ring 6), without casing 2, without the anchor plate, and without the coupling part of FIG. 2. In this way, leaking seals of all kinds on the inner body are immediately apparent.

On the other hand, the armature in the pressurized, closed operational state can be exposed without a problem by removing the operating lever 1, the head casings 17*a* and 17*b*, as well as the coupling part of FIG. 2, the casing 2 and the anchor plate 8, in order to conduct maintenance. For this the water does not need to be drained and/or the single-point armature does not need to be removed from the connection unit 7.

The casing 2 is held on the inner body by a screw 16 so that it neither turns nor slips. This in turn is required for the continual pressure of the sealing means 9 under the anchor plate 8, and for enabling the relative rotatability of the armature head (1, 17, 17*a*) for the operation of the armature. The head of the screw 16 produces this mounting as a result of its height H, even when only partially screwed in.

Figure 2B:
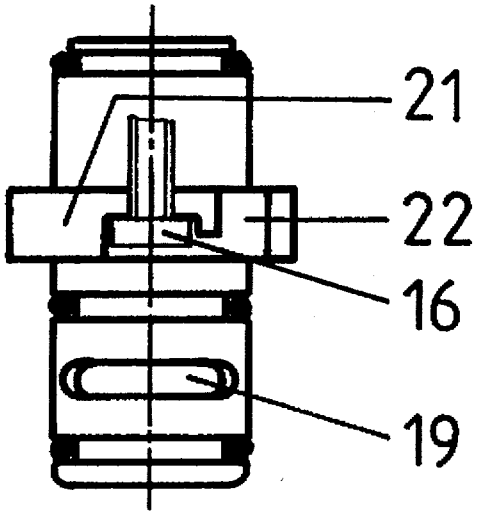
FIG. 2*a* is a side elevation and FIG. 2*b* is a rear view.
Figure 2A:
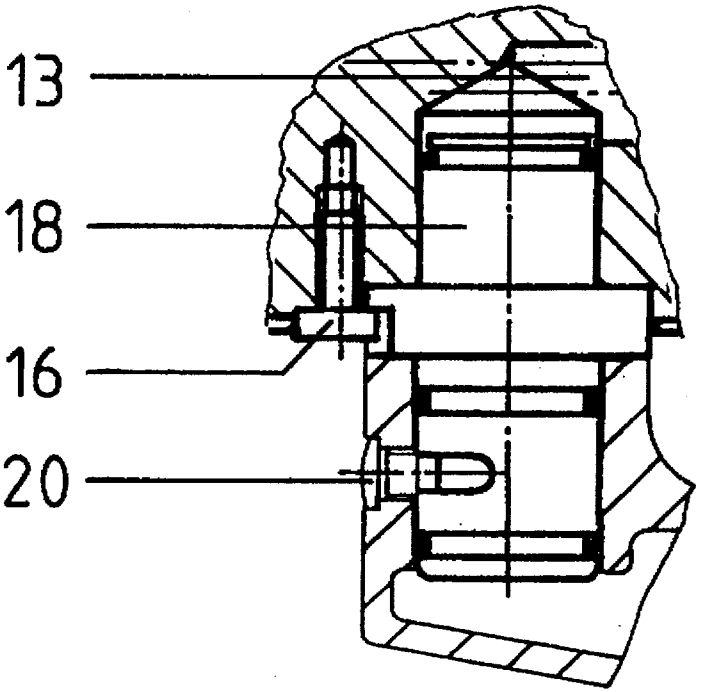

The coupling part of the discharge nozzle 14, 14*a*, 14*b* is shown in FIGS. 2*a* and 2*b*. The screw 16 serves additionally as a holder and locking piston for the pivot bearing element 18. The easy changeability and combinability of discharge nozzles of various lengths and designs 14*a*, 14*b* with the already similar single-point armature body are already known. The coupling and arrangement of the pivoting discharges result from a depending peg, similar to pivot bearing element 18, and a fixing screw 20. The known pivot bearing elements are, however, mostly screwed in or soldered in the armature body so that they cannot rotate. In the construction in accordance with the invention, however, the coupling is easily removable. This pivot bearing element 18 contains on one side a groove 19, which serves to limit the rotating angle of the nozzle 14, and extends as a peg into the nozzle. The nozzle is attached to this peg by a fixing screw 20, and so forms, together with the pivot bearing element 18, a preassembled, testable assembly, which is sealed in itself and against the inner body 3 with O-rings in a suitable manner.

To guarantee an advantageous quick assembly, the pivot bearing element 18 carries a collar 21, which serves as a depth stopper and which has bayonet catch type indentations 22. Thus, the discharge preassembly of the single-point armature, consisting of pivot bearing element 18 and pivoting discharge nozzle 14, can be introduced into the inner body 3 for quick and easy rotational movement suitable for the screw 16, which is not yet completely screwed in, following the bayonet catch type indentations. It is then secured against falling out and twisting in the inner body 3 by tightening the screw 16 against the stopper collar 21. Thus, the double function of the screw 16 (fixing of the casing 2 on one hand and keeping the pivoting bearing element 18 from twisting on the other hand) is achieved.

Between the casing 2 and the inner body 3 a relatively large airspace 24 exists. This provides the advantage of a light-weight construction of the single-point armature assembly, and temperature isolation of the casing 3. Thus, when the inner body heats up as a result of dispensing hot water, the danger of burning when touching the single-point armature on the casing 3 is eliminated.

I claim:

1. A single-point armature assembly adapted to be mounted on an armature connection unit in a building wall and trimmed by a surrounding escutcheon plate, and carrying at least one mixing valve manipulable by at least one operating element comprising:

an inner body of the armature assembly having channels for cold and hot water;

a casing enclosing the inner body; and a quick coupling means inserted into the inner body and removably connected to the inner body, for removably connecting a discharge means to the inner body.

2. A single-point armature assembly as in claim 1, wherein the casing is mountable on and removable from the inner body in both axial directions.

3. A single-point armature assembly as in claim 1, wherein an airspace exists between the casing and the inner body.

4. A single-point armature as in claim 1, wherein said quick coupling means is mounted directly to the inner body.

5. A single-point armature as in claim 4, wherein the casing is mountable on and removable from the inner body in both axial directions.

6. A single-point armature as in claim 4, wherein an airspace exists between the casing and the inner body.

7. A single-point armature assembly adapted to be mounted on an armature connection unit in a building wall and trimmed by a surrounding escutcheon plate, and carrying at least one mixing valve manipulable by at least one operating element comprising:

an inner body of the armature assembly having channels for cold and hot water;

a casing enclosing the inner body;

a quick coupling means mounted to the inner body for removably connecting a discharge means to the inner body; and attachment means for connection with the armature connection unit, including a sleeve nut and a retaining ring cooperable with a securing ring, the retaining ring being mounted in a circumferential groove of the inner body, an inwardly directed flange of the sleeve nut having an axial play between the securing ring and an outwardly directed flange of the inner body on which the casing is centered.

8. A single-point armature assembly as in claim 7, wherein the sleeve nut has a larger diameter than the armature casing, the casing being cylindrical.

9. A single-point armature assembly in accordance with claim 3, wherein the casing is designed as one piece, and is secured by an attachment element of the quick coupling means, the attachment element operated from the outside.

10. A single-point armature assembly as in claim 9, wherein the attachment element simultaneously secures the casing and a pivot bearing element of a discharge nozzle.

11. A single-point armature assembly as in claim 10, wherein the pivot bearing element forms a subassembly with a discharge nozzle.

12. A single point armature assembly as in claim 10, wherein the attachment element is a screw with a screw head engaging into a bayonet catch type indentation in a collar of the pivot bearing element.

13. A single-point armature assembly as in claim 7, wherein the casing is mountable on and removable from the inner body in both axial directions.

14. A single-point armature assembly as in claim 7, wherein an airspace exists between the casing and the inner body.

15. A single-point armature assembly adapted to be mounted on an armature connection unit in a building wall and trimmed by a surrounding escutcheon plate, and carrying at least one mixing valve manipulable by at least one operating element comprising:

an inner body of the armature assembly having channels for cold and hot water;

a casing enclosing the inner body; and a quick coupling means mounted to the inner body for removably connecting a discharge means to the inner body, wherein the quick coupling means is a screw with a screw head engaging into a bayonet catch type indentation in a collar of the discharge means.

* * * * *